United States Patent [19]

Bates et al.

[11] 4,396,165

[45] Aug. 2, 1983

[54] METHOD AND APPARATUS FOR LOADING A COIL OF STEEL STRAPPING INTO A DISPENSING CARTON THEREFOR

[75] Inventors: Marvin O. Bates, Bensenville; Michael F. Pfister, Downers Grove, both of Ill.

[73] Assignee: Punch-Lok Company, Chicago, Ill.

[21] Appl. No.: 304,189

[22] Filed: Sep. 21, 1981

[51] Int. Cl.[3] ..... B65D 85/67; B65H 55/00; B21C 47/02; B21C 47/28

[52] U.S. Cl. ..... 242/78.1; 242/55; 242/67.1 R; 242/170; 206/409

[58] Field of Search ..... 206/395, 408, 409; 221/70, 71; 229/175; 242/55, 55.53, 55.54, 56 R, 67.1, 78, 78.1, 78.3, 78.6, 78.8, 105, 137.1, 146, 159, 163, 170

[56] References Cited

U.S. PATENT DOCUMENTS

| | | | |
|---|---|---|---|
| 2,542,882 | 2/1951 | Shumway . | |
| 2,554,615 | 5/1951 | Dahle . | |
| 2,579,131 | 12/1951 | Tinsley . | |
| 2,639,873 | 5/1953 | Smith . | |
| 2,713,938 | 7/1955 | Snyder . | |
| 2,991,958 | 7/1961 | Eifrid . | |
| 3,052,425 | 9/1962 | Reed et al. | 242/105 |
| 3,114,456 | 12/1963 | Van Billiard . | |
| 3,258,212 | 6/1966 | LaTour | 242/78.1 |
| 3,390,844 | 7/1968 | Dillow et al. . | |
| 3,693,784 | 9/1972 | Holmes . | |
| 3,810,588 | 5/1974 | Mahoney . | |
| 4,139,163 | 2/1979 | Tabel et al. | 242/67.1 R X |

*Primary Examiner*—Stuart S. Levy
*Assistant Examiner*—Lloyd D. Doigan
*Attorney, Agent, or Firm*—Robert E. Wagner; Ralph R. Rath

[57] ABSTRACT

In loading a carton with a coil of steel strapping for dispensing through a central circular aperture in the front wall of the carton, the carton is mounted on a mandrel which is received through the dispensing opening in the carton, the mandrel having a cylindrical winding surface disposed within the carton and having one or more radial slots therein. The leading end of a supply of steel strapping is fed through an open end of the carton and inserted into the slot and the mandrel is rotated for winding a coil of steel strapping thereon. The loaded carton is then removed from the mandrel. Retaining means are provided for holding the carton in place in its loading position on the mandrel so as to prevent rotation of the carton and bulging of the front and rear walls thereof during the winding operation.

20 Claims, 7 Drawing Figures

FIG. 5
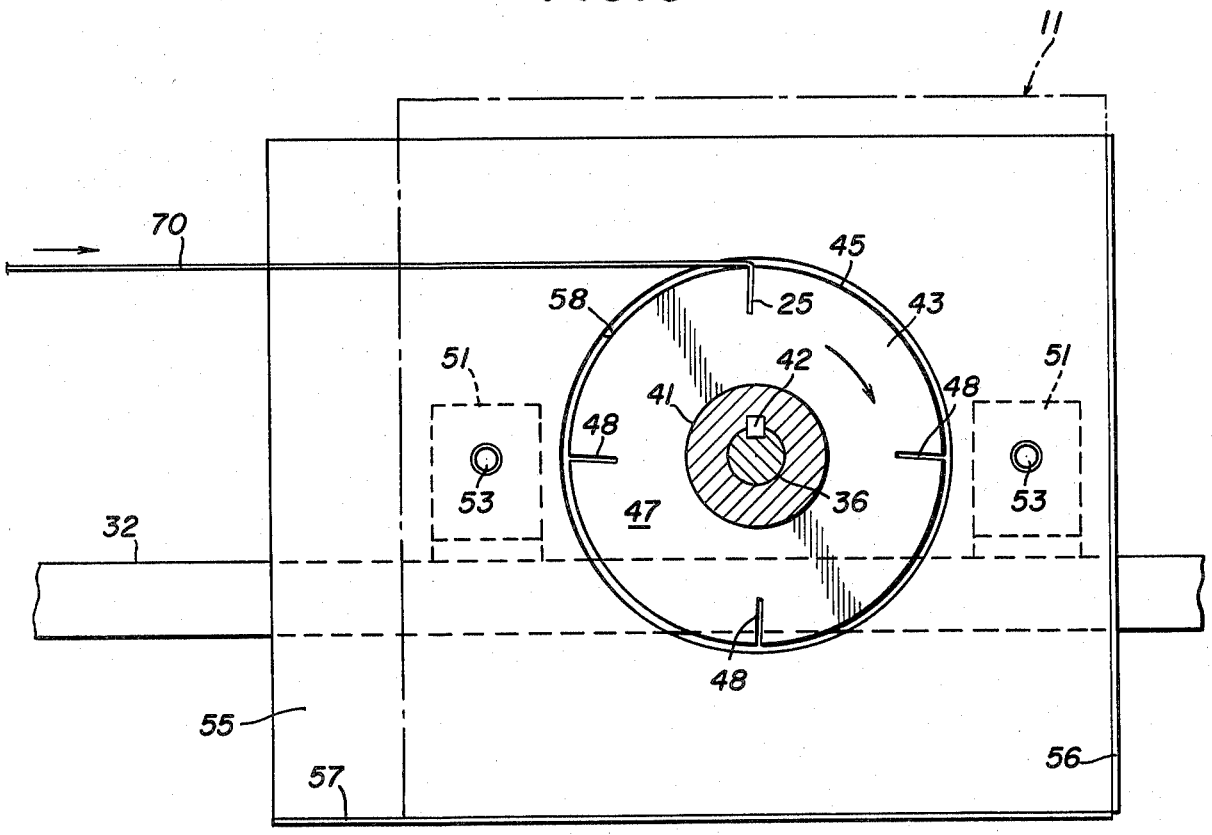
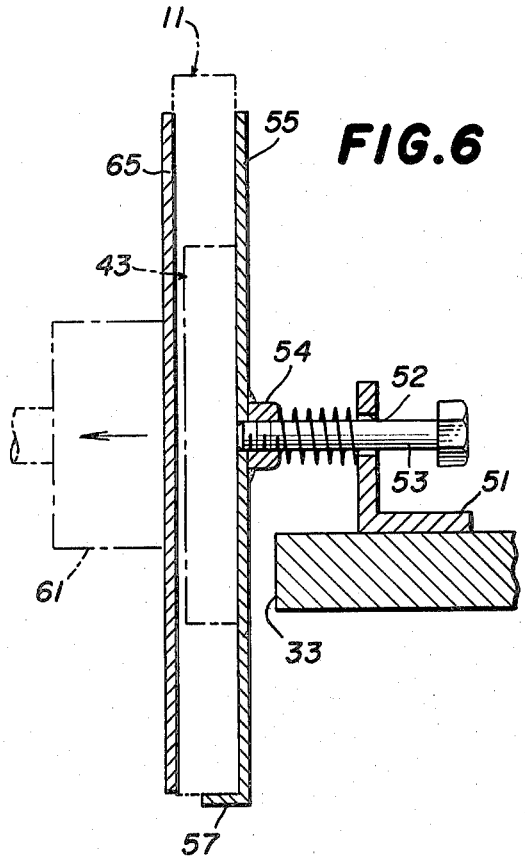
FIG. 6
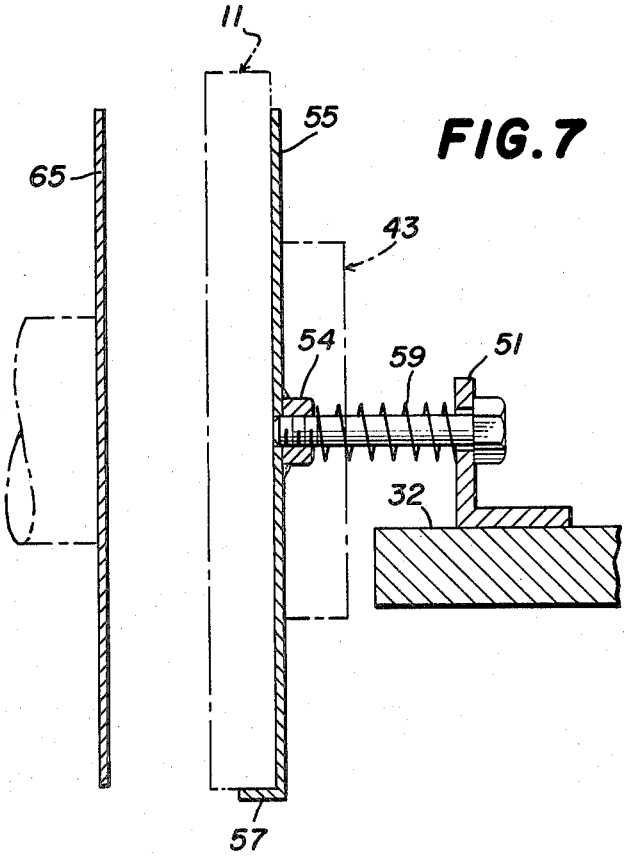
FIG. 7

METHOD AND APPARATUS FOR LOADING A COIL OF STEEL STRAPPING INTO A DISPENSING CARTON THEREFOR

BACKGROUND OF THE INVENTION

The present invention relates to a dispensing carton for containing and dispensing a coil of steel strapping, and in particular to a method and apparatus for loading the coil of strapping into the container.

Steel strapping of the type which is used for hose clamps, for mounting traffic signs on line poles, for fastening fence to posts and the like, is typically provided in a package comprising a coil of the strapping disposed in a dispensing carton. The strapping is commonly dispensed from the outer end of the coil through a dispensing slot disposed at one corner of the carton. Thus, as the strapping is dispensed, it is necessary that the entire coil thereof be rotated within the carton. This necessitates the use of both hands, one to withdraw the strapping from the carton and the other to hold the carton stationary while the coil is rotated therein. In loading this prior art type of dispensing carton, the coil is typically prewound and then the completed coil is inserted into the carton. This necessitates handling of the coil of steel strapping, which must be done very carefully to avoid accidental unwinding of the coil.

SUMMARY OF THE INVENTION

The present invention relates to an improved dispensing carton for steel strapping and a method and apparatus for loading same which avoids the disadvantages of prior art dispensing systems and affords additional structural and operating advantages.

It is a general object of the present invention to provide a method of loading a coil of steel strapping into a dispensing carton which obviates handling of the coil.

In connection with the foregoing object, it is another object of this invention to provide a method of the type set forth, wherein the resulting package affords easy dispensing of the steel strapping from the carton with the use of only one hand.

In connection with the foregoing object, it is another object of this invention to provide a method of the type set forth, wherein the resulting package permits the easy dispensing of the steel strapping from the carton and replacement of dispensed strapping in the carton without rotation of the coil.

It is another object of this invention to provide an apparatus for loading a coil of metal strapping into a dispensing carton in accordance with the method set forth.

These and other objects of the invention are attained by providing a method of loading a coil of metal strapping into a dispensing carton having front and rear walls interconnected by a peripheral end wall, at least a portion of which end wall is foldable between open and closed conditions, the front wall having a circular dispensing opening therein centrally thereof, comprising the steps of: providing a mandrel having a cylindrical winding surface with a diameter slightly less than that of the dispensing opening in the carton and having a radially extending slot in the winding surface, folding the one end wall of the carton to its open condition, mounting the carton on the mandrel in a loading position with the winding surface received through the dispensing opening in the carton and disposed within the carton, then inserting the leading end of a supply of steel strapping into the carton through the open end thereof and into the slot in the winding surface of the mandrel, then rotating the mandrel about the axis of the winding surface to wind the steel strapping into a coil on the winding surface within the carton, then removing the carton and the coil contained therein from the mandrel.

The invention consists of certain novel features and a combination of parts and method steps hereinafter fully described, illustrated in the accompanying drawings, and particularly pointed out in the appended claims, it being understood that various changes in the details may be made without departing from the spirit, or sacrificing any of the advantages of the invention.

BRIEF DESCRIPTION OF THE DRAWINGS

FIG. 5 is a view in vertical section taken along the line 5—5 in FIG. 4; and illustrating the apparatus at the beginning of the winding operation;

FIG. 6 is a view in vertical section taken along the line 6—6 in FIG. 3, and illustrating the retaining assembly of the present invention in its retaining position; and FIG. 7 is a view similar to FIG. 6, illustrating the retaining assembly in its release position.

DESCRIPTION OF THE PREFERRED EMBODIMENT

Figure 1:
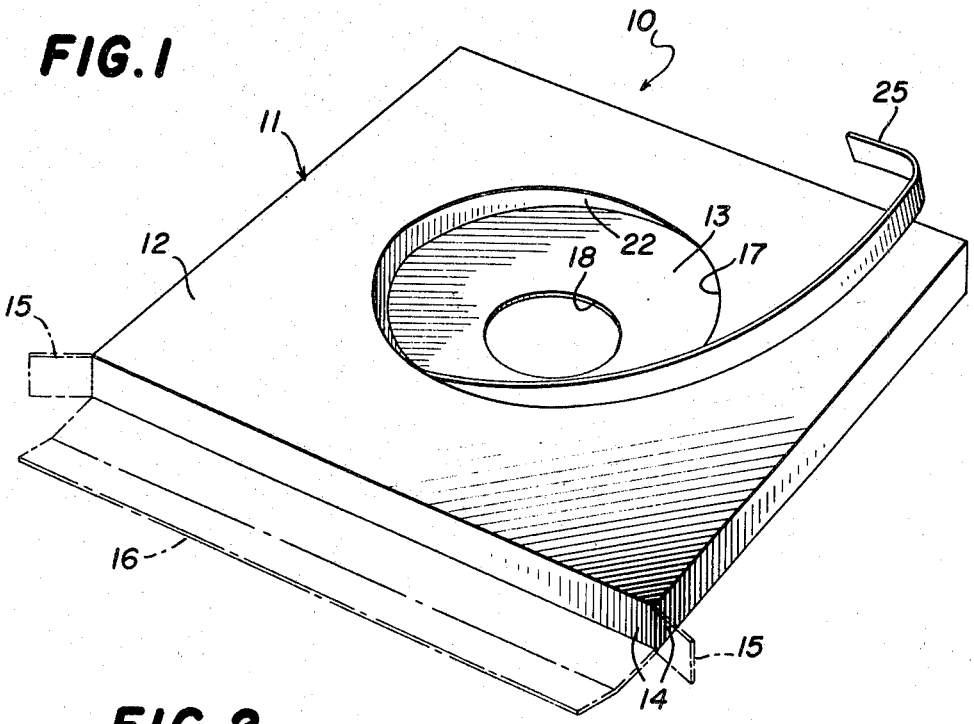
FIG. 1 is a perspective view of a dispensing container containing a coil of steel strapping and loaded in accordance with the present invention, illustrating the manner in which the strapping is dispensed; and the manner in which one end of the carton may be opened for loading.
Figure 2:
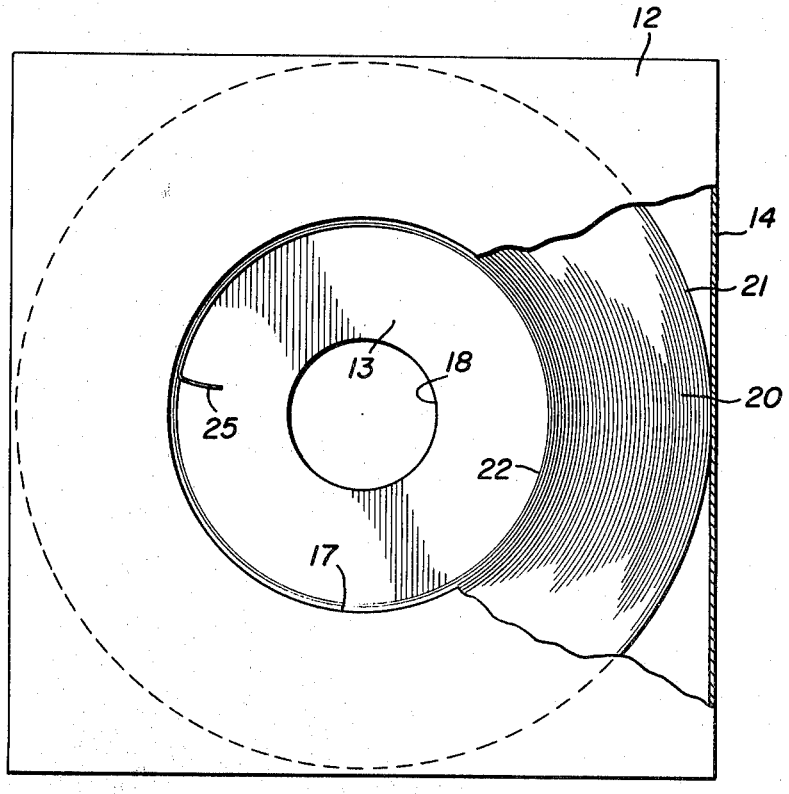
FIG. 2 is a top plan view of the dispensing carton of FIG. 1, with portions of the front wall thereof broken away to show the coil contained therein.

Referring to FIGS. 1 and 2 of the drawings, there is illustrated a strapping package 10, which comprises a carton 11 containing therein a coil 20 of steel strapping to be dispensed from the carton 11, the strapping package 10 being formed by the method and apparatus of the present invention. The carton 11 is preferably formed of cardboard and is generally rectangular in shape, including parallel front and rear rectangular walls 12 and 13 interconnected by four end walls 14. At least one of the end walls 14 is foldable between an open condition illustrated in broken line in FIG. 1 and a closed condition illustrated in solid line in FIGS. 1 and 2. That end wall 14 preferably includes two corner tabs 15 and a flap 16 which are foldable to open and close the end wall 14 in a well-known manner. The front wall 12 has a large circular dispensing opening 17 formed centrally therein and the rear wall 13 has a small circular opening 18 formed therein substantially coaxial with the dispensing housing 17.

The coil 20 of strapping is preferably a continuous coil of metal strapping such a steel strapping, the coil having an outer surface 21 disposed substantially tangent to the end walls 14 and an inner surface 22 having a diameter approximately the same as that of the dispensing opening 17 and coaxial therewith. The inner end of the coil 20 has a short radially inwardly extending tab 25. The strapping package 10, as illustrated in FIG. 2, is substantially as it appears when the loading operation of the present invention is completed.

In dispensing the steel strapping from the carton 11, the tab 25 is grasped by a user and the inner end of the coil 20 is withdrawn through the dispensing opening 17, as indicated in FIG. 1. It will be appreciated that in thus dispensing the steel strapping from the inside of the coil 20, the strap can simply be peeled from the coil without rotation of the coil 20 itself. There is no danger of accidental unraveling of the coil 20, since the natural bias of the strapping by reason of the curvature thereof causes it to tend to expand within the carton 11, so that the coil 20 tends to move away from the dispensing opening 17 rather than toward it. For this same reason, if too much strapping is accidentally withdrawn from the carton 11, it can easily be replaced in the carton 11 by simply pushing it back in through the dispensing opening 17, the replaced length of strapping naturally tending to expand outwardly and seat itself against the inside of the coil 20. Preferably, when the user replaces the inner end of the steel strapping in the carton 11, he will bend it to form a new tab 25 so as to facilitate withdrawal for the next dispensing operation. The small opening 18 in the rear wall 13 of the carton 11 may be used to receive a T-clip or the like to facilitate hanging the strapping package 10 from a utility belt of the user or the like.

Referring now to FIGS. 3 through 7 of the drawings, there is illustrated a loading apparatus, generally designated by the numeral 30, for loading the coil 20 of steel strapping into the carton 11. The loading apparatus 30 is perferably mounted on a support platform 31 which may be a table or workbench or the like, the support platform 31 having a top surface 32 and terminating at a front edge 33. The support platform 31 preferably has an aperture 34 therethrough for receiving therein the lower portion of a sheave 35 which is fixedly secured to a coaxial shaft 36 rotatably mounted in pillow blocks 37 which are fixedly secured to the top surface 32 of the support platform 31, as by threaded fasteners 38. Preferably, the sheave 35 is centered between the pillow blocks 37 and is maintained in that position by means of collars 39 which are fixedly secured to the shaft 36 and respectively disposed outboard of the pillow blocks 37.

One end of the shaft 36 projects outwardly beyond the front edge 33 of the support platform 31 and has fixedly secured thereto a mandrel, generally designated by the numeral 40. More specifically, the mandrel 40 includes a cylindrical hub 41 keyed to the shaft 36 as by a key 42 (see FIG. 5). The mandrel 40 has an enlarged-diameter winding plate 43 intermediate the ends thereof which has a cylindrical outer winding surface 45 bounded by annular parallel front and rear surfaces 46 and 47. Formed in the winding surface 45 at equiangularly spaced-apart points thereon and extending radially into the winding plate 43 are four narrow rectangular slots 48, each extending transversely completely across the winding plate 43 from the front surface 46 to the rear surface 47. In use, the shaft 36 and the mandrel 40 thereon are rotated by a suitable drive belt 49 or the like (see FIG. 4) which extends around the sheave 35 and is coupled to an associated drive motor (not shown).

The loading apparatus 30 also includes a retaining assembly, generally designated by the numeral 50, which includes two angle brackets 51 respectively disposed on opposite sides of the shaft 36 and fixedly secured to the support platform 31 adjacent to the front edge 33 thereof. Each of the angle brackets 51 has a circular hole 52 formed through the vertical flange thereof, for respectively receiving therethrough two bolts 53, which are in turn threadedly engaged with nuts 54 which are fixedly secured, as by welding, to a large rectangular inner retaining plate 55 disposed beyond the front edge 33 of the support platform 31. The inner retaining plate 55 has a side flange 56 projecting outwardly from one vertical side edge 33 and a bottom flange 57 projecting outwardly along the bottom edge thereof, the flanges 56 and 57 being disposed substantially normal to the inner retaining plate 55. Formed through the inner retaining plate 55 centrally thereof between the nuts 54 is a large circular aperture 58 having a diameter slightly greater than that of the winding surface 45 of the mandrel 40.

Two helical compression springs 59 are respectively disposed in surrounding relationship with the bolts 53 and are trapped between the nuts 54 and the angle brackets 51 for resiliently urging the inner retaining plate 55 to the left, as viewed in FIGS. 3, 4, 6 and 7. It will be appreciated that by reason of the length of the bolts 53 and the use of the springs 59, the inner retaining plate 55 is movable between the positions illustrated in FIGS. 6 and 7, this movement being accommodated by the circular aperture 58 which permits the winding plate 43 of the mandrel 40 to pass therethrough.

The retaining assembly 50 also includes a clamp mechanism, generally designated by the numeral 60, which comprises a cylindrical clamp block 61 fixedly secured to one end of a connecting rod 62, the other end of which is coupled to a conventional toggle mechanism 63, only a portion of which is illustrated in the drawings, and which is preferably mounted by suitable means (not shown) on either the support platform 31 or another associated support. The clamp block 61 is arranged with the axis thereof substantially parallel to the axis of the shaft 36, outboard of the mandrel 40. The surface of the clamp block 61 facing the mandrel 40 has formed therein a cylindrical recess 64 centrally thereof having a diameter slightly greater than the hub portion 41 of the mandrel 40. Fixedly secured to that surface of the clamp block 61, as by screws 66, is a rectangular outer retaining plate 65, which has formed therein centrally thereof a circular aperture 67 arranged in registry with the cylindrical recess 64. Preferably, the screws 66 are equiangularly spaced apart around the periphery of the cylindrical recess 64.

Figure 3:
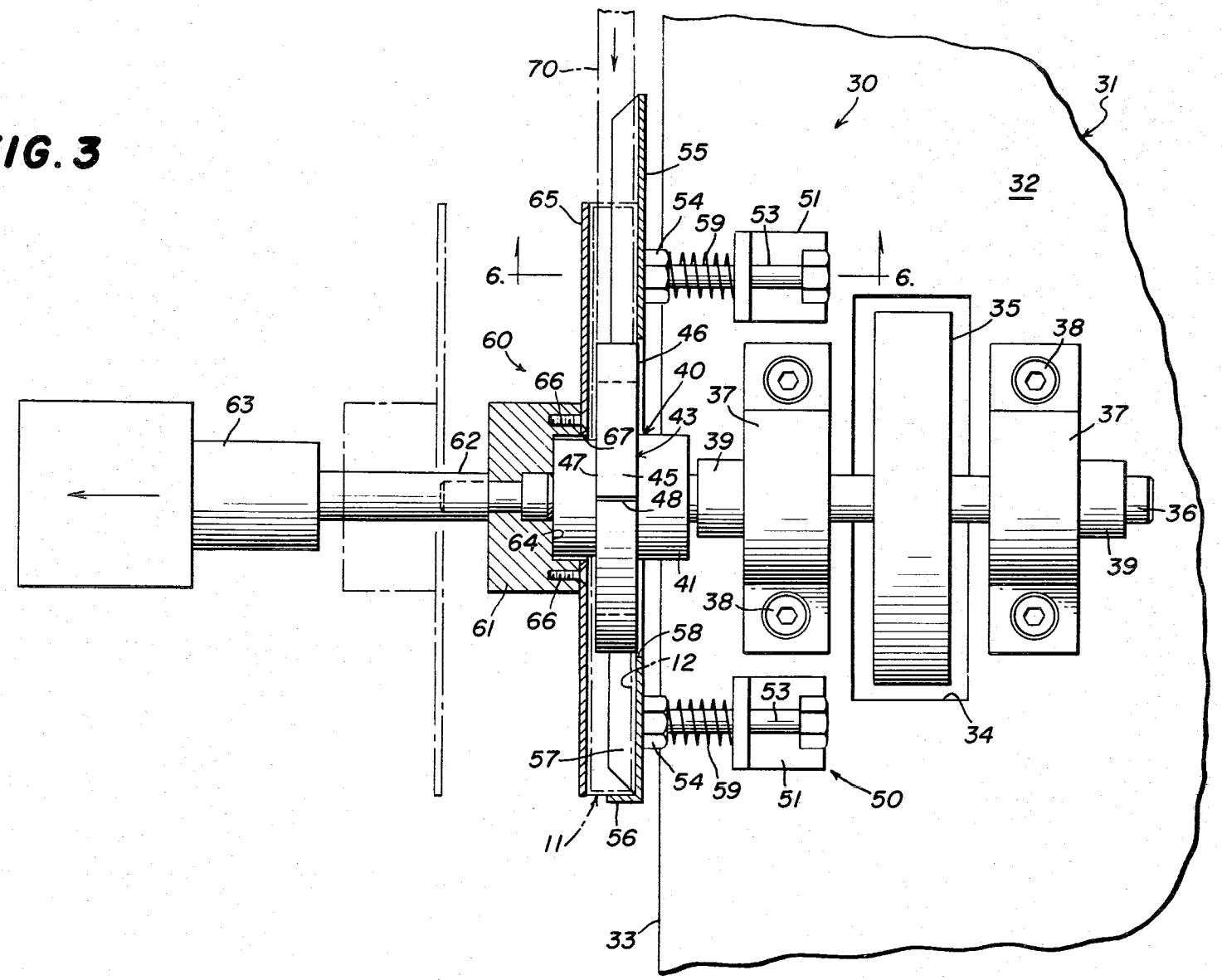
FIG. 3 is a top plan view of apparatus constructed in accordance with the present invention for loading a coil of steel strapping into the container of FIG. 1, with portions of the mechanism broken away more clearly to illustrate the construction.
Figure 4:
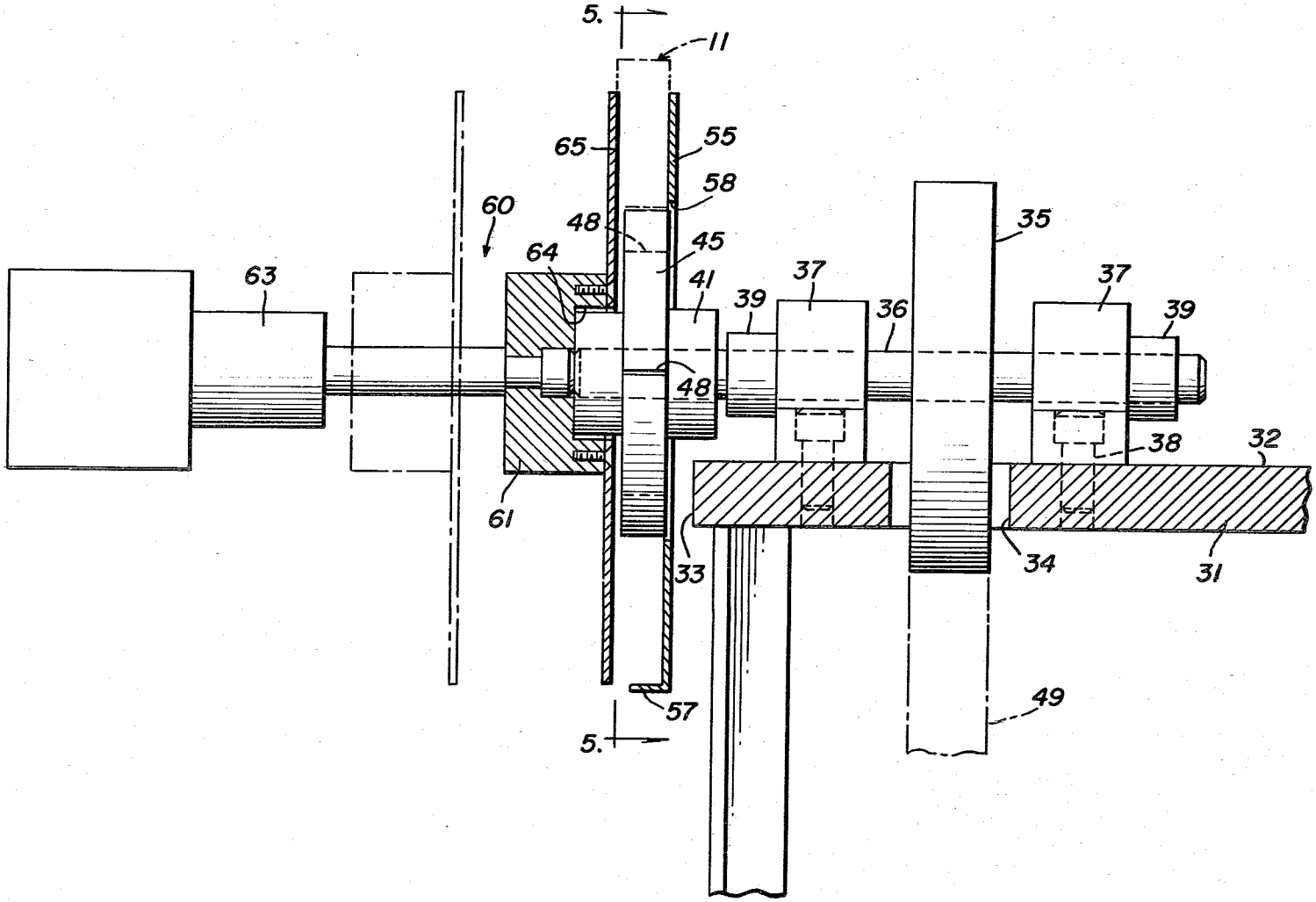
FIG. 4 is a side elevational view of the apparatus of FIG. 3, with portions broken away more clearly to illustrate the construction.

In use, the clamp mechanism 60 is movable by actuation of the toggle mechanism 63 between a clamping or retaining position illustrated in FIG. 6 and in solid line in FIGS. 3 and 4 and a release position illustrated in FIG. 7 and in broken line in FIGS. 3 and 4. When the clamp mechanism 60 is disposed in its retaining position, the outer end of the hub portion 41 of the mandrel 40 is received in the cylindrical recess 64 of the clamp block 61 and the outer retaining plate 65 is disposed substantially parallel to the inner retaining plate 55 and spaced therefrom a distance approximately equal to the thickness of the carton 11, whereby the retaining plates 55 and 65 cooperate to retain the carton 11 therebetween and effectively prevent expansion or bulging of the front and rear walls 12 and 13 of the carton 11 during the loading thereof, as will be explained more fully below. When the clamp mechanism 60 is disposed in its release position, the outer retaining plate 65 is spaced outwardly well away from the mandrel 40 a distance sufficient to permit movement of the inner retaining plate 55 to its retaining position and removal of the carton 11 from the mandrel 40.

The operation of the loading apparatus 30 during the loading of a carton 11 will now be explained. Initially, the retaining assembly 50 will be disposed in its release condition, i.e., the inner retaining plate 55 will be disposed in its release position illustrated in FIG. 7 and the outer retaining plate 65 will be disposed in its release position illustrated in broken line in FIGS. 3 and 4. An empty carton 11, having one end wall 14 thereof folded open, as indicated in broken line in FIG. 1, is then mounted on the loading apparatus 30. More specifically, the carton 11 is oriented with the open end thereof facing the associated supply of steel strapping and with the front wall 12 facing the mandrel 40. The large dispensing opening 17 is then fitted over the winding plate 43 of the mandrel 40 until the winding surface 45 is disposed within the carton 11 and the outer end of the hub 41 extends through the small opening 18 in the rear wall 13 of the carton 11. During the mounting operation, the inner retaining plate 55 will be moved inwardly to its retaining position illustrated in FIG. 6, against the urging of the compression springs 59, and the carton 11 will be seated on the bottom flange 57 and inside the vertical flange 56, as illustrated in FIGS. 3 through 5.

The clamp mechanism 60 is then moved to its retaining position and latched therein by the toggle mechanism 63. When the clamp mechanism 60 is thus secured in its retaining position, the outer retaining plate 65 cooperates with the inner retaining plate 55 to retain the carton 11 therebetween, and the clamp mechanism 60 serves to hold the inner retaining plate 55 in its retaining position.

Next, the leading end of the supply portion 70 of steel strapping is fed into the open end of the carton 11 and inserted into one of the slots 48 in the winding surface 45. Because there are four slots 48, at least one of the slots 48 will always be generally facing the open end of the carton 11 to facilitate insertion of the leading end of the strap therein. Preferably, the winding surface 45 has a width approximately equal to the width of the steel strapping. The drive motor of the loading apparatus 30 is then energized or engaged for rotating the shaft 36 and the mandrel 40 in the direction of the arrow in FIG. 5, thereby to wind the steel strapping into a coil 20 on the winding surface 45. Because the thickness of the carton 11 is preferably only slightly greater than the width of the steel strapping 70, the strapping will engage the inner surfaces of the carton 11 during the winding operation. But the inner and outer retaining plates 55 and 65 will prevent expansion of the carton 11, and the flanges 56 and 57 of the inner retaining plate 55 will prevent rotation of the carton 11.

When a predetermined measured length of steel strapping has been wound onto the coil 20, the drive motor is stopped or disengaged and the supply portion 70 of the steel strapping is severed from the coil 20 and the open end of the carton 11 is closed. The clamp mechanism 60 is then moved to its release position, thereby permitting the operator to move the inner retaining plate 55 to its release position to strip the completed package 10 from the mandrel 40, this stripping action being assisted by the bias springs 59. Because the slots 48 extend all the way through the winding plate 43, the portion of the strap disposed therein can readily be moved from the slot 48 axially of the mandrel 40. It will be appreciated that this portion of the steel strapping extends radially inwardly of the package 10, projecting into the dispensing opening 17 and forming the tab 25. The apparatus is now ready for the mounting of the next carton 11 thereon.

The inner and outer retaining plates 55 and 65 may be formed of any suitable material having the necessary rigidity to perform the retaining function. Thus, the retaining plates 55 and 65 may be formed of plastic or metal or a combination thereof. Similarly, it will be appreciated that any suitable means could be used for mounting the plates 55 and 65 on the associated parts.

From the foregoing, it can be seen that there has been provided an improved method and apparatus for loading a coil of metal strapping into a dispensing carton therefor, which apparatus and method obviate handling of the wound coil and provide a strapping package which affords easy one-handed dispensing.

We claim:

1. A method of loading a coil of metal strapping into a dispensing carton having front and rear walls interconnected by a peripheral end wall, at least a portion of which end wall is foldable between open and closed conditions, the front wall having a circular dispensing opening therein centrally thereof, comprising the steps of: providing a mandrel having a cylindrical winding surface with a diameter slightly less than that of the dispensing opening in the carton and having a radially extending slot in the winding surface, folding the one end wall of the carton to its open condition, mounting the carton on the mandrel in a loading position with the winding surface received through the dispensing opening in the carton and disposed within the carton, then inserting the leading end of a supply of steel strapping into the carton through the open end thereof and into the slot in the winding surface of the mandrel, then rotating the mandrel about the axis of the winding surface to wind the steel strapping into a coil on the winding surface within the carton, then removing the carton and the coil contained therein from the mandrel.

2. The method of claim 1, and further including the step of retaining the carton in its loading position on the mandrel and confining the front and rear walls against expansion during the rotation of the mandrel.

3. The method of claim 1, and further including the step of retaining the carton against rotation during the winding operation.

4. The method of claim 1, and further including the step of severing the completed coil from the supply of steel strapping.

5. The method of claim 4, wherein the coil is severed from the supply of steel strapping prior to removal of the carton and the coil contained therein from the mandrel.

6. The method of claim 4, and further including the step of folding the one end wall of the carton to its closed condition after severance of the coil from the supply of steel strapping.

7. Apparatus for loading a coil of metal strapping into a dispensing carton having front and rear walls interconnected by a peripheral end wall, at least a portion of which end wall is foldable between open and closed conditions, the front wall having a circular dispensing opening therein centrally thereof, said apparatus comprising a mandrel having a cylindrical winding surface with a diameter slightly less than that of the dispensing opening in the carton for passage therethrough to accommodate mounting of the carton on the mandrel in a loading position with the winding surface disposed within the carton and the one end wall open, said winding surface having a radial slot therein dimensioned to receive therein the leading end of a supply of steel strapping fed through the open end of the carton in its loading position, drive means for rotating said mandrel about the axis of said winding surface for winding the steel strapping into a coil thereon, and retaining means for holding the carton in its loading position during the winding of the steel strapping on said winding surface of said mandrel.

8. The apparatus of claim 7, wherein said winding surface has a plurality of radial slots formed therein equiangularly spaced apart therearound.

9. The apparatus of claim 7, wherein said retaining means is movable between a retaining position engageable with the carton for holding it in its loading position and a release position accommodating movement of the carton to and from its loading position.

10. The apparatus of claim 7, wherein said retaining means includes means for preventing rotation of the carton during the winding of the steel strapping on said winding surface of said mandrel.

11. The apparatus of claim 7, wherein said retaining means includes means for preventing expansion of the front and rear walls of the carton during the winding of the steel strapping on said winding surface of said mandrel.

12. The apparatus of claim 7, wherein said radial slot extends transversely through said mandrel to accommodate removal of the carton and the completed coil contained therein from said mandrel axially of said winding surface, the portion of the steel strapping disposed in said slot forming a radial tab at the inner end of the completed coil to facilitate grasping of said inner end and withdrawal thereof from the carton through the dispensing opening.

13. Apparatus for loading a coil of metal strapping into a dispensing carton having front and rear walls interconnected by a peripheral end wall, at least a portion of which end wall is foldable between open and closed conditions, the front wall having a circular dispensing opening therein centrally thereof, said apparatus comprising a mandrel having a cylindrical winding surface with a diameter slightly less than that of the dispensing opening in the carton for passage therethrough to accommodate mounting of the carton on the mandrel in a loading position with the winding surface disposed within the carton and the one end wall open, said winding surface having a radial slot therein dimensioned to receive therein the leading end of a supply of steel strapping fed through the open end of the carton in its loading position, drive means for rotating said mandrel about the axis of said winding surface for winding the steel strapping into a coil thereon, first retaining means engageable with the front wall of the carton in its loading position, and second retaining means movable between a retaining position engageable with the rear wall of the carton in its loading position for cooperation with said first retaining means to retain the carton therebetween and a release position out of engagement with the carton and accommodating movement of the carton to and from its loading position.

14. The apparatus of claim 13, wherein the rear wall of the dispensing carton has a small circular opening therein coaxial with the dispensing opening, said mandrel having a reduced diameter hub portion coaxial with said winding surface and extending axially therefrom at the front and rear ends thereof, the rear end of said hub portion being accommodated in said small opening in the rear wall of the carton when the carton is mounted in its loading position.

15. The apparatus of claim 14, wherein said second retaining means includes a rectangular plate disposed substantially parallel to the rear surface of the carton in its loading position, said retaining plate having a circular aperture therethrough for accommodating therein the rear end of said hub portion when said second retaining means is in its retaining position.

16. The apparatus of claim 13, wherein said first retaining means includes a rectangular retaining plate having a circular opening therethrough coaxial with said winding surface of said mandrel and having a diameter slightly greater than that of said winding surface, said retaining plate being shiftable between a retaining position spaced slightly forwardly of said winding surface and a release position disposed slightly rearwardly of said winding surface to facilitate removal of the carton and the coil therein from said mandrel.

17. The apparatus of claim 16, and further including means resiliently urging said retaining plate to the release position thereof.

18. The apparatus of claim 16, wherein said second retaining means includes a rectangular plate disposed substantially parallel to the rear surface of the carton in its loading position.

19. The apparatus of claim 16, and further including a retaining flange extending from said retaining plate substantially normal thereto along at least one edge thereof for engagement with the end wall of the carton in its loading position to prevent rotation of the carton during the winding of the steel strapping on said winding surface of said mandrel.

20. The apparatus of claim 13, wherein said second retaining means includes a rectangular plate disposed substantially parallel to the rear surface of the carton in its loading position.

* * * * *